US010368183B2

(12) United States Patent
Holman

(10) Patent No.: US 10,368,183 B2
(45) Date of Patent: Jul. 30, 2019

(54) DIRECTIVITY OPTIMIZED SOUND REPRODUCTION

(71) Applicant: Apple Inc., Cupertino, CA (US)

(72) Inventor: Tomlinson M. Holman, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/311,828

(22) PCT Filed: Sep. 26, 2014

(86) PCT No.: PCT/US2014/057829
§ 371 (c)(1),
(2) Date: Nov. 16, 2016

(87) PCT Pub. No.: WO2015/178950
PCT Pub. Date: Nov. 26, 2015

(65) Prior Publication Data

US 2017/0105084 A1 Apr. 13, 2017

Related U.S. Application Data

(60) Provisional application No. 62/000,226, filed on May 19, 2014.

(51) Int. Cl.
*H04R 5/02* (2006.01)
*H04R 29/00* (2006.01)
(Continued)

(52) U.S. Cl.
CPC ..... *H04S 7/302* (2013.01); *H04R 1/403* (2013.01); *H04R 5/02* (2013.01); *H04R 5/04* (2013.01); *H04S 3/008* (2013.01); *H04S 3/00* (2013.01)

(58) Field of Classification Search
CPC ..... G10H 1/0091; G10H 2210/046; H04R 2203/12
(Continued)

(56) References Cited

U.S. PATENT DOCUMENTS

2003/0125933 A1 7/2003 Saunders et al.
2008/0212805 A1 9/2008 Fincham
(Continued)

FOREIGN PATENT DOCUMENTS

WO WO 2014/036085 A1 3/2014

OTHER PUBLICATIONS

PCT International Search Report and Written Opinion for PCT International Appln No. PCT/US2014/057829 dated Jan. 20, 2015 (9 pages).

*Primary Examiner* — George C Monikang
(74) *Attorney, Agent, or Firm* — Womble Bond Dickinson (US) LLP

(57) ABSTRACT

An audio system is described that receives a piece of sound program content for playback from a content distribution system. The piece of sound program content may include a multi-channel dialog signal and a combined multi-channel music and effects signal. The audio system may determine a first set of directivity patterns for the multi-channel dialog signal and a second set of directivity patterns for the combined multi-channel music and effects signal. The first set of directivity patterns associated with channels of the dialog signal may have higher directivity indexes than the second set of directivity patterns associated with corresponding channels of the music and effects signal. By associating dialog components with a higher directivity than music and effects components, the system increases the intelligibility of dialog for a piece of sound program content while allowing music and effects to retain conventional
(Continued)

directivity having a typical ratio of direct-to-reverberant sound energy.

8 Claims, 10 Drawing Sheets

(51) Int. Cl.
*H04S 7/00* (2006.01)
*H04R 1/40* (2006.01)
*H04R 5/04* (2006.01)
*H04S 3/00* (2006.01)

(58) Field of Classification Search
USPC ..... 381/303, 310, 58–59
See application file for complete search history.

(56) References Cited

U.S. PATENT DOCUMENTS

2010/0183156 A1* 7/2010 Park ..... G10K 11/178 381/17
2010/0296678 A1* 11/2010 Kuhn-Rahloff ..... H04S 7/30 381/303
2011/0069850 A1 3/2011 Harma

* cited by examiner

DIRECTIVITY OPTIMIZED SOUND REPRODUCTION

RELATED MATTERS

This application is a U.S. National Phase Application under 35 U.S.C. § 371 of International Application No. PCT/US2014/057829, filed Sep. 26, 2014, which claims the benefit of the earlier filing date of U.S. provisional application No. 62/000,226, filed May 19, 2014.

FIELD

A system and method for controlling the directivity of dialogue channels separate from music and effects channels in a piece of sound program content is described. Other embodiments are also described.

BACKGROUND

Sound program content, including movies and television shows, are often composed of several distinct audio components, including dialogue of characters/actors, music and sound effects. Each of these component parts called stems may include multiple spatial channels and are mixed together prior to delivery to a consumer. For example, a production company may mix a 5.1 channel dialogue stream or stem, a 5.1 music stream, and a 5.1 effects stream into a single master 5.1 audio mix or stream. This master stream may thereafter be delivered to a consumer through a recordable medium (e.g., DVD or Blu-ray) or through an online streaming service. Although mixing dialogue, music, and effects to form a single master mix or stream is convenient for purposes of distribution, this process often results in poor audio reproduction for the consumer. For example, intelligibility of dialogue may become an issue because the dialogue component for a piece of sound program content must be played back using the same settings as music and effects components since each of these components are unified in a single master stream. Dialogue intelligibility has become a growing and widely perceived problem, especially amongst movies played through television sets where dialogue may be easily lost amongst music and effects.

SUMMARY

An embodiment of the invention is related to an audio system that receives a piece of sound program content for playback from a content distribution system. The piece of sound program content may include multiple components or stems. For example, the piece of sound program content may include a multi-channel dialogue signal, a multi-channel music signal, and a multi-channel effects signal. In one embodiment, the multi-channel music signal may be combined or mixed with the multi-channel effects signal to form a combined multi-channel music and effects signal.

In one embodiment, the audio system or the content distribution system may determine a first set of directivity patterns for the multi-channel dialogue signal and a second set of directivity patterns for the combined multi-channel music and effects signal. Each of the directivity patterns in the first and second sets of directivity patterns may be characterized by a directivity index. The directivity index of a beam pattern defines the ratio of sound emitted at a target (e.g., a listener) in comparison to sound emitted generally into a listening area. In one embodiment, the first set of directivity patterns associated with channels of the dialogue signal have higher directivity indexes than the second set of directivity patterns associated with corresponding channels of the combined music and effects signal. By associating dialogue components with a higher directivity than music and effects components, the system described herein increases the intelligibility of dialogue for a piece of sound program content while allowing music and effects to retain conventional directivity having a typical ratio of direct-to-reverberant sound energy.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
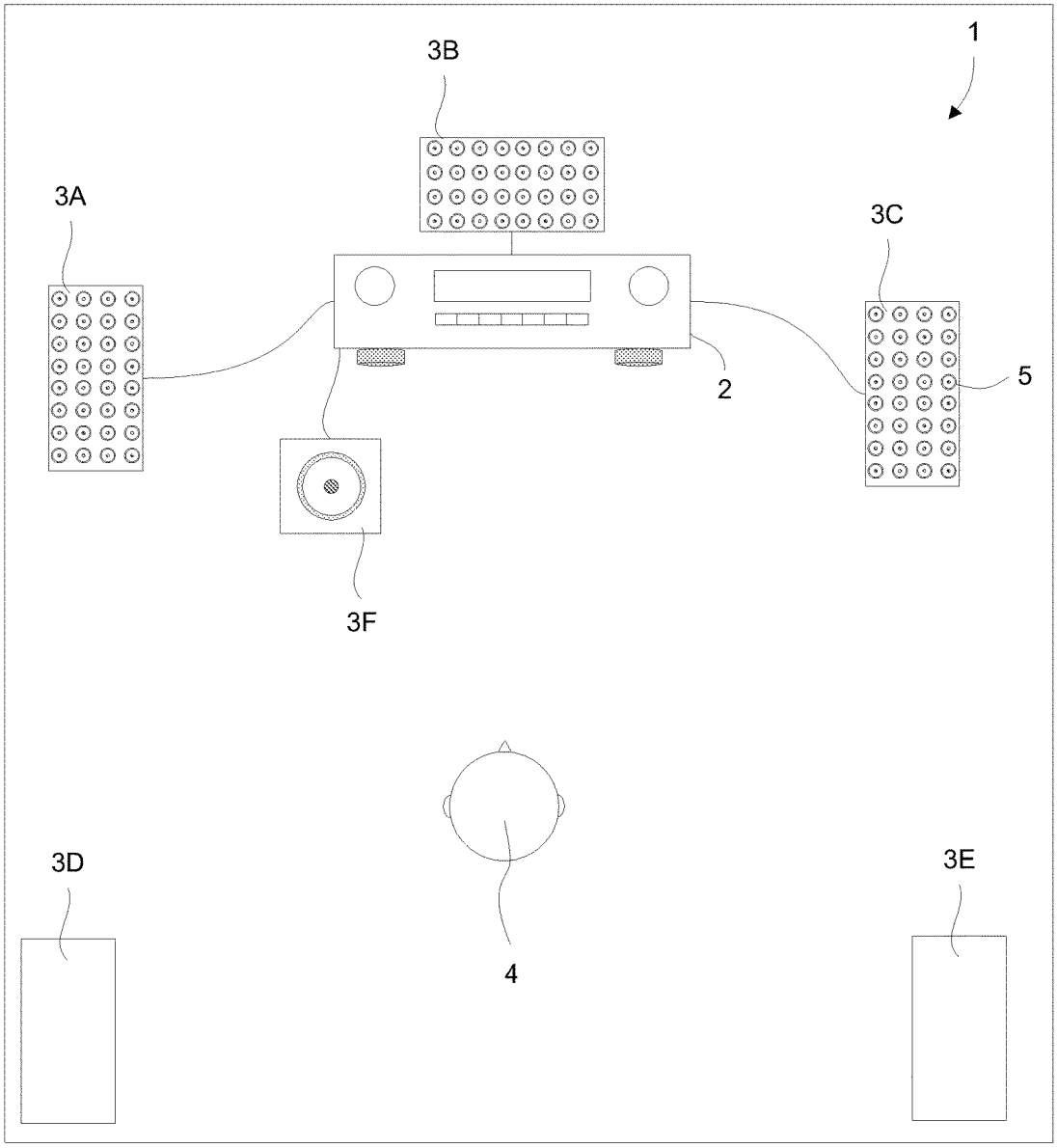
FIG. 1A shows a view of a listening area with an audio receiver, a set of six loudspeaker arrays, and a listener according to one embodiment of the invention.

FIG. 1A shows a view of a listening area 1 with an audio receiver 2, a set of loudspeaker arrays 3A-3F, and a listener 4. The audio receiver 2 may be coupled to the set of loudspeaker arrays 3A-3F to drive individual transducers 5 in the loudspeaker arrays 3A-3F to emit various sound/beam/polar patterns into the listening area 1 as will be described in further detail below. The sound emitted by the loudspeaker arrays 3A-3F represents sound program content played by the receiver 2.

As noted above, the loudspeaker arrays 3A-3F emit sound into the listening area 1. The listening area 1 is a location in which the loudspeaker arrays 3A-3F are located and in which a listener 4 is positioned to listen to sound emitted by the loudspeaker arrays 3A-3F. For example, the listening area 1 may be a room within a house or a commercial establishment or an outdoor area (e.g., an amphitheater).

Figure 1B:
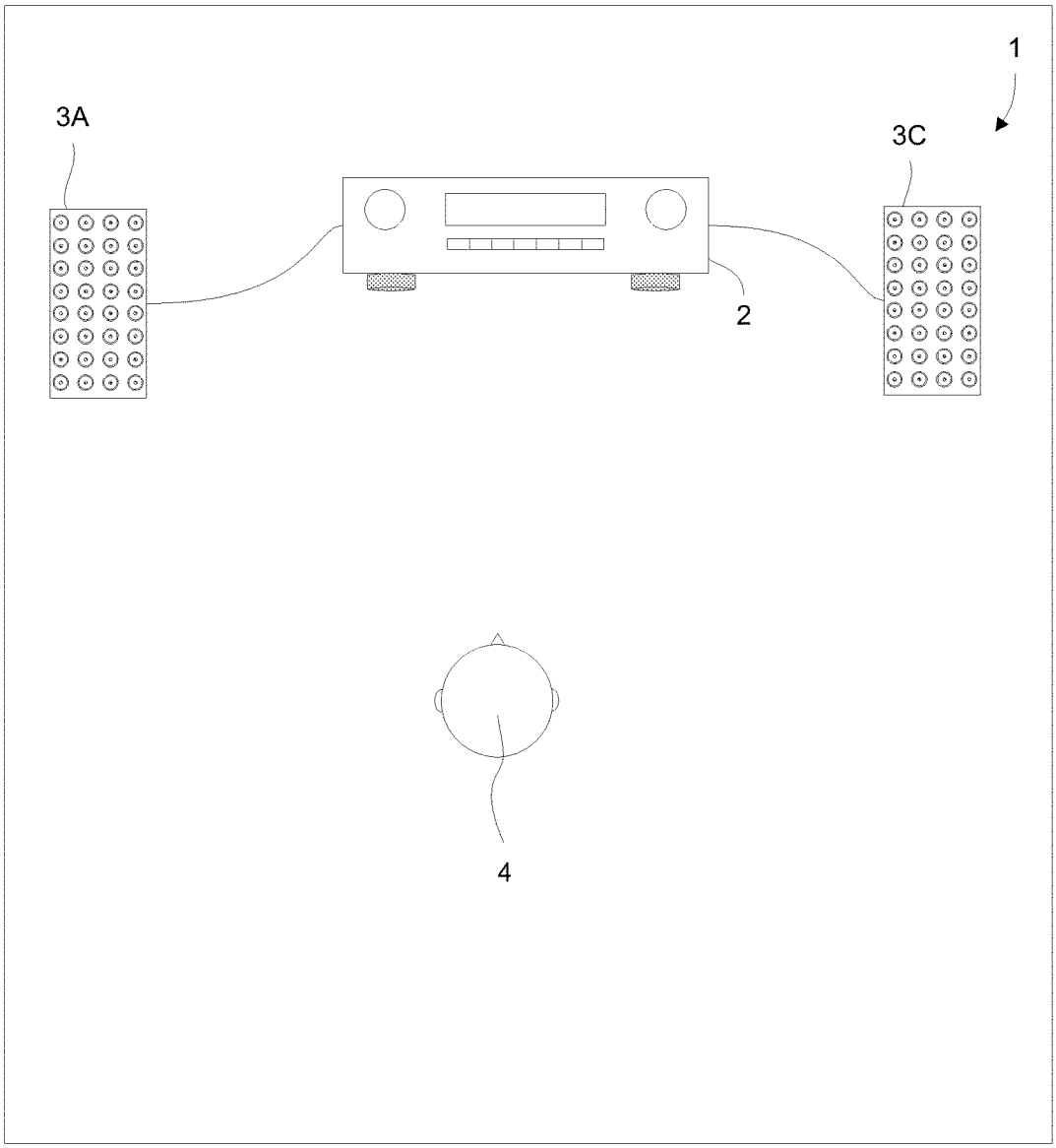
FIG. 1B shows a view of a listening area with an audio receiver, a set of two loudspeaker arrays, and a listener according to one embodiment of the invention.

The loudspeaker arrays 3A-3F shown in FIG. 1A may represent six audio channels for a piece of multichannel sound program content (e.g., a musical composition or an audio track for a movie recorded/encoded as 5.1 audio). For example, each of the loudspeaker arrays 3A-3F may each represent one of a front left channel, a front center channel, a front right channel, a left surround channel, a right surround channel, and a subwoofer channel for a piece of sound program content. In other embodiments, different configurations of the loudspeaker arrays 3A-3F may be used. For example, as shown in FIG. 1B, two loudspeaker arrays 3A and 3C may be used to represent sound for a piece of sound program content played or otherwise output by the receiver 2. In these embodiments, each of the loudspeaker arrays 3A and 3C may be assigned multiple channels of audio for a piece of sound program content (e.g., two or more of a front left channel, a front center channel, a front right channel, a left surround channel, a right surround channel, and a subwoofer channel). In one embodiment, the loudspeaker arrays 3A and 3C may collectively produce an audio channel. For example, the loudspeaker arrays 3A and 3C may be driven to collectively produce a front center channel for a piece of sound program content. In this example, the generated front center channel is a "phantom" channel that appears to emanate from a source directly in front of the listener 4, but is instead the product of sound produced off axis by the loudspeaker arrays 3A and 3C, which are located to the left and right of the listener 4.

Although six channel audio content is used as an example (e.g., 5.1 audio), the systems and methods described herein for optimizing sound reproduction may be similarly applied to any type of sound program content, including monophonic sound program content, stereophonic sound program content, eight channel sound program content (e.g., 7.1 audio), and eleven channel sound program content (e.g., 9.2 audio).

The loudspeaker arrays 3A-3F may be coupled to the audio receiver 2 through the use of wires and/or conduit. For example, as shown in FIG. 1A, the loudspeaker arrays 3A, 3B, 3C, and 3F are connected to the audio receiver 2 using wires or other types of electrical conduit. In this embodiment, each of the loudspeaker arrays 3A, 3B, 3C, and 3F may include two wiring points, and the audio receiver 2 may include complementary wiring points. The wiring points may be binding posts or spring clips on the back of the loudspeaker arrays 3A, 3B, 3C, and 3F and the audio receiver 2, respectively. The wires are separately wrapped around or are otherwise coupled to respective wiring points to electrically connect the loudspeaker arrays 3A, 3B, 3C, and 3F to the audio receiver 2.

In other embodiments, the loudspeaker arrays 3A-3F may be coupled to the audio receiver 2 using wireless protocols such that the loudspeaker arrays 3A-3F and the audio receiver 2 are not physically joined but maintain a radio-frequency connection. For example, as shown in FIG. 1A, the loudspeaker arrays 3D and 3E are coupled to the audio receiver 2 using wireless signals. In this embodiment, each of the loudspeaker arrays 3D and 3E may include a Bluetooth and/or WiFi receiver for receiving audio signals from a corresponding Bluetooth and/or WiFi transmitter in the audio receiver 2. In some embodiments, the loudspeaker arrays 3D and 3E may be standalone units that each include components for signal processing and for driving each transducer 5 according to the techniques described below. For example, in some embodiments, the loudspeaker arrays 3D and 3E may include integrated amplifiers for driving corresponding integrated transducers 5 using wireless audio signals received from the audio receiver 2.

Figure 2:
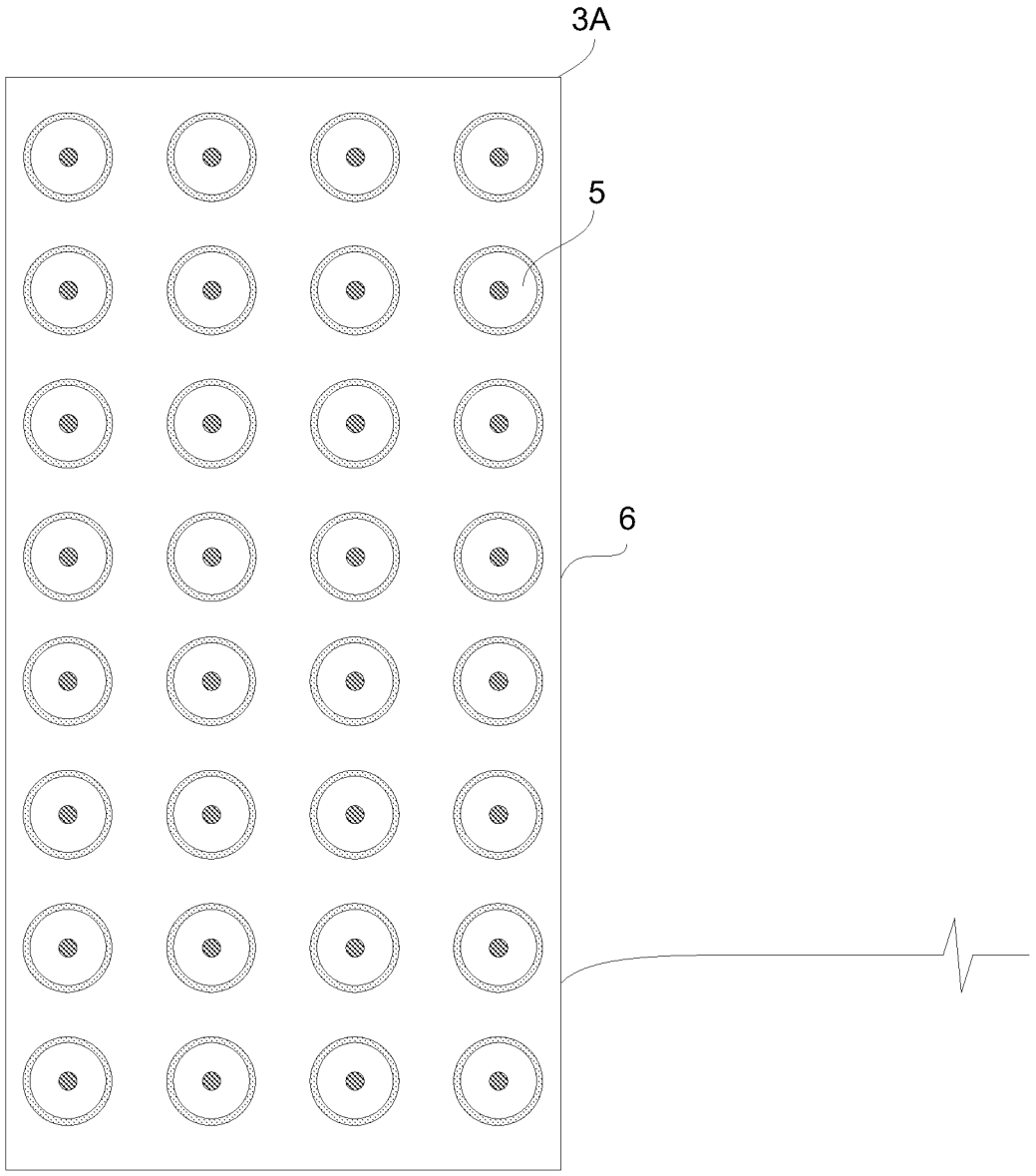
FIG. 2 shows a loudspeaker array with multiple transducers housed in a single cabinet according to one embodiment of the invention.

As noted above, the loudspeaker arrays 3A-3F may include one or more transducers 5 housed in a single cabinet 6. For example, FIG. 2 shows the loudspeaker array 3A with multiple transducers 5 housed in a single cabinet 6. In this example, the loudspeaker array 3A has thirty-two transducers 5. The transducers 5 may be mid-range drivers, woofers, and/or tweeters. Each of the transducers 5 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 5 magnetic system interact, generating a mechanical force that causes the coil (and thus, the attached cone) to move back and forth, thereby reproducing sound under the control of the applied electrical audio signal coming from a source (e.g., a signal processor, a computer, and/or the audio receiver 2).

Figure 3:
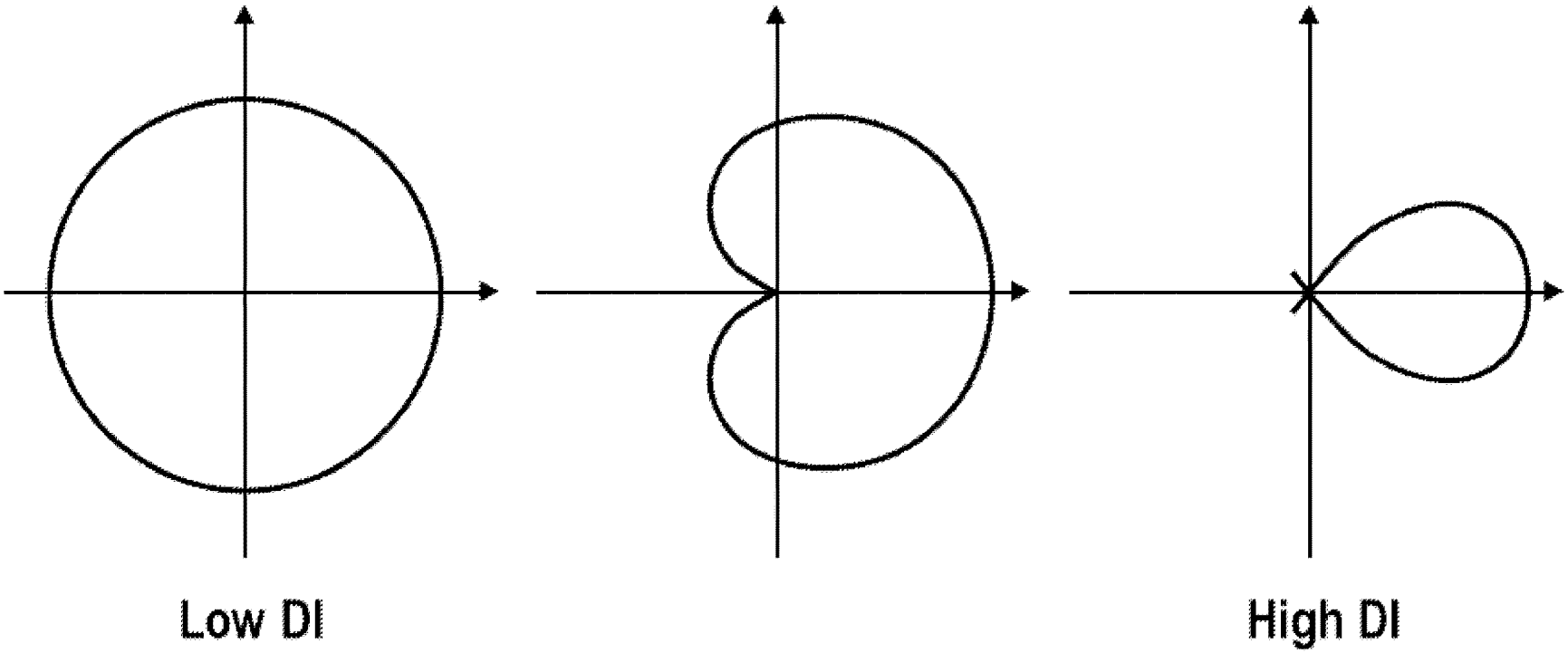
FIG. 3 shows an example set of directivity patterns with varied directivity indexes that may be produced by each of the loudspeaker arrays according to one embodiment of the invention.

Each transducer 5 may be individually and separately driven to produce sound in response to separate and discrete audio signals received from an audio source (e.g., the audio receiver 2). By allowing the transducers 5 in the loudspeaker arrays 3A-3F to be individually and separately driven according to different parameters and settings (including delays and energy levels), the loudspeaker arrays 3A-3F may produce numerous beam patterns with varied directivity indexes. For example, FIG. 3 shows an example set of directivity patterns with varied directivity indexes that may be produced by each of the loudspeaker arrays 3A-3F. The directivity index of a beam pattern defines the ratio of sound emitted at a target (e.g., the listener 4) in comparison to sound emitted generally into the listening area 1. Accordingly, the directivity indexes of the beam patterns shown in FIG. 3 increase from left to right. As will be explained in greater detail below, the receiver 2 or another computing device may alter or otherwise assign different directivity indexes to components of a piece of sound program content (e.g., a first beam pattern with a first directivity index for a channel of a multi-channel dialogue signal and a second beam pattern with a second directivity index for a channel of a combined multi-channel music and effects signal). The use of separate directivity indexes for separate components of a piece of sound program content optimizes sound reproduction by, for example, increasing the intelligibility of dialogue while allowing music and effects to retain conventional directivity having a typical ratio of direct-to-reverberant sound energy.

Figure 4:
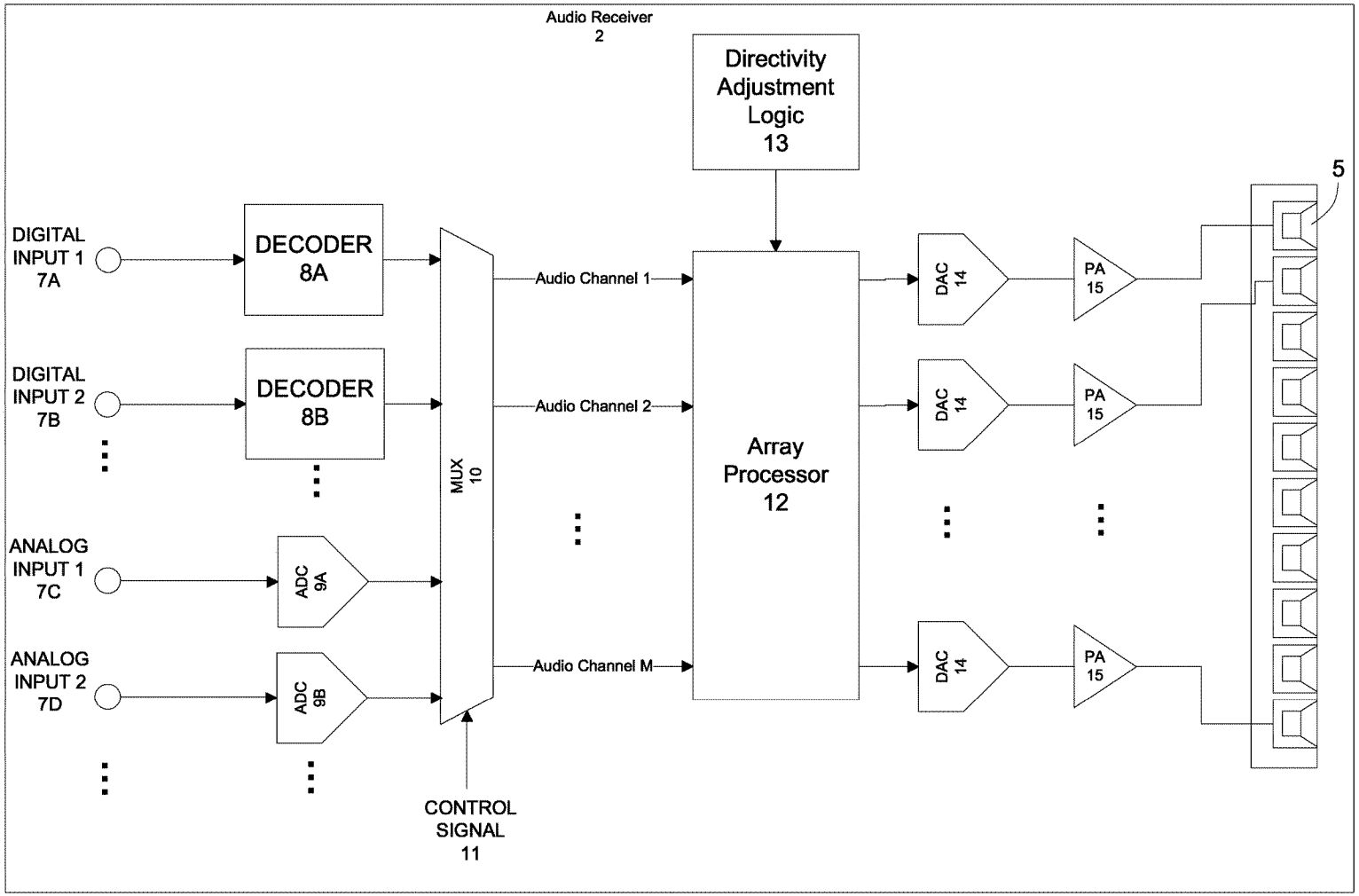
FIG. 4 shows a functional unit block diagram and some constituent hardware components of the audio receiver according to one embodiment of the invention.

FIG. 4 shows a functional unit block diagram and some constituent hardware components of the audio receiver 2 according to one embodiment of the invention. Although shown as separate in FIG. 1A and FIG. 1B, in one embodiment the audio receiver 2 may be integrated within one or more of the loudspeaker arrays 3A-3F as shown in FIG. 4. The components shown in FIG. 4 are representative of elements included in the audio receiver 2 and should not be construed as precluding other components. Each element of the audio receiver 2 as shown in FIG. 4 will be described by way of example below.

The audio receiver 2 may include multiple inputs 7A-7D for receiving sound program content using electrical, radio, and/or optical signals from an external device or system. The inputs 7A-7D may be a set of digital inputs 7A and 7B and analog inputs 7C and 7D including a set of physical connectors located on an exposed surface of the audio receiver 2. For example, the inputs 7A-7D may include a High-Definition Multimedia Interface (HDMI) input, an optical digital input (Toslink), and a coaxial digital input. In one embodiment, the audio receiver 2 receives audio signals through a wireless connection with an external system or device. In this embodiment, the inputs 7A-7D include a wireless adapter for communicating with an external device using wireless protocols. For example, the wireless adapter may be capable of communicating using one or more of Bluetooth, IEEE 802.3, the IEEE 802.11 suite of standards, cellular Global System for Mobile Communications (GSM), cellular Code Division Multiple Access (CDMA), or Long Term Evolution (LTE).

General signal flow from the inputs 7A-7D will now be described. Looking first at the digital inputs 7A and 7B, upon receiving a digital audio signal through an input 7A or 7B, the audio receiver 2 uses a decoder 8A or 8B to decode the electrical, optical, or radio signals into a set of audio channels representing sound program content. For example, the decoder 8A may receive a single signal containing six audio channels (e.g., a 5.1 signal) and decode the signal into six audio signals for each of the six audio channels. The six audio channels/signals may respectively correspond to front left, front center, front right, left surround, right surround, and low-frequency effect audio channels. In another embodiment, the decoder 8A may receive multiple multi-channel audio signals corresponding to separate components of a single piece of sound program content. For example, the multiple signals decoded by the decoder 8A may correspond to a multi-channel dialogue signal/stem and a combined multi-channel music and effects signal/stem for a piece of sound program content. The decoder 8A may decode each of the received signals into corresponding channels for the piece of sound program content. The decoders 8A and 8B may be capable of decoding audio signals encoded using any codec or technique, including Advanced Audio Coding (AAC), MPEG Audio Layer II, and MPEG Audio Layer III.

Turning to the analog inputs 7C and 7D, each analog signal received by analog inputs 7C and 7D represents a single audio channel of the sound program content. Accordingly, multiple analog inputs 7C and 7D may be needed to receive each channel of a piece of multichannel sound program content (e.g., each channel of a multi-channel dialogue stream/stem and/or a multi-channel music and effects stream/stem). The analog audio channels may be digitized by respective analog-to-digital converters 9A and 9B to form digital audio channels.

The digital audio channels from each of the decoders 8A and 8B and the analog-to-digital converters 9A and 9B are output to the multiplexer 10. The multiplexer 10 selectively outputs a set of audio channels based on a control signal 11. The control signal 11 may be received from a control circuit or processor in the audio receiver 2 or from an external device. For example, a control circuit controlling a mode of operation of the audio receiver 2 may output the control signal 11 to the multiplexer 10 for selectively outputting a set of digital audio channels from one or more of the inputs 7A-7D.

The multiplexer 10 feeds the selected digital audio channels to an array processor 12 for processing. The channels output by the multiplexer 10 are processed by the array processor 12 to produce a set of processed audio signals for driving each loudspeaker array 3A-3F. In one embodiment, the array processor 12 may process the channels output by the multiplexer 10 using input from the directivity adjustment logic 13. As will be discussed in greater detail below, the directivity adjustment logic 13 may determine a set of beam patterns for a multi-channel dialogue signal of a piece of sound program content and a set of beam patterns for a combined multi-channel music and effects signal of the piece of sound program content. Each beam pattern in these sets of beam patterns may be characterized by separate directivity indexes, which are selected to improve the intelligibility of dialogue and overall reproduction of the sound program content.

The array processor 12 may operate in both the time and frequency domains using transforms such as the Fast Fourier Transform (FFT). The array processor 12 may be a special purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines). As shown in FIG. 4, the processed sets of audio signals are passed from the array processor 12 to the one or more digital-to-analog converters 14 to produce one or more distinct analog signals. The analog signals produced by the digital-to-analog converters 14 are fed to the power amplifiers 15 to drive selected transducers 5 of the loudspeaker arrays 3A-3F such that the beam patterns received from the directivity adjustment logic 13 are generated.

Figure 5:
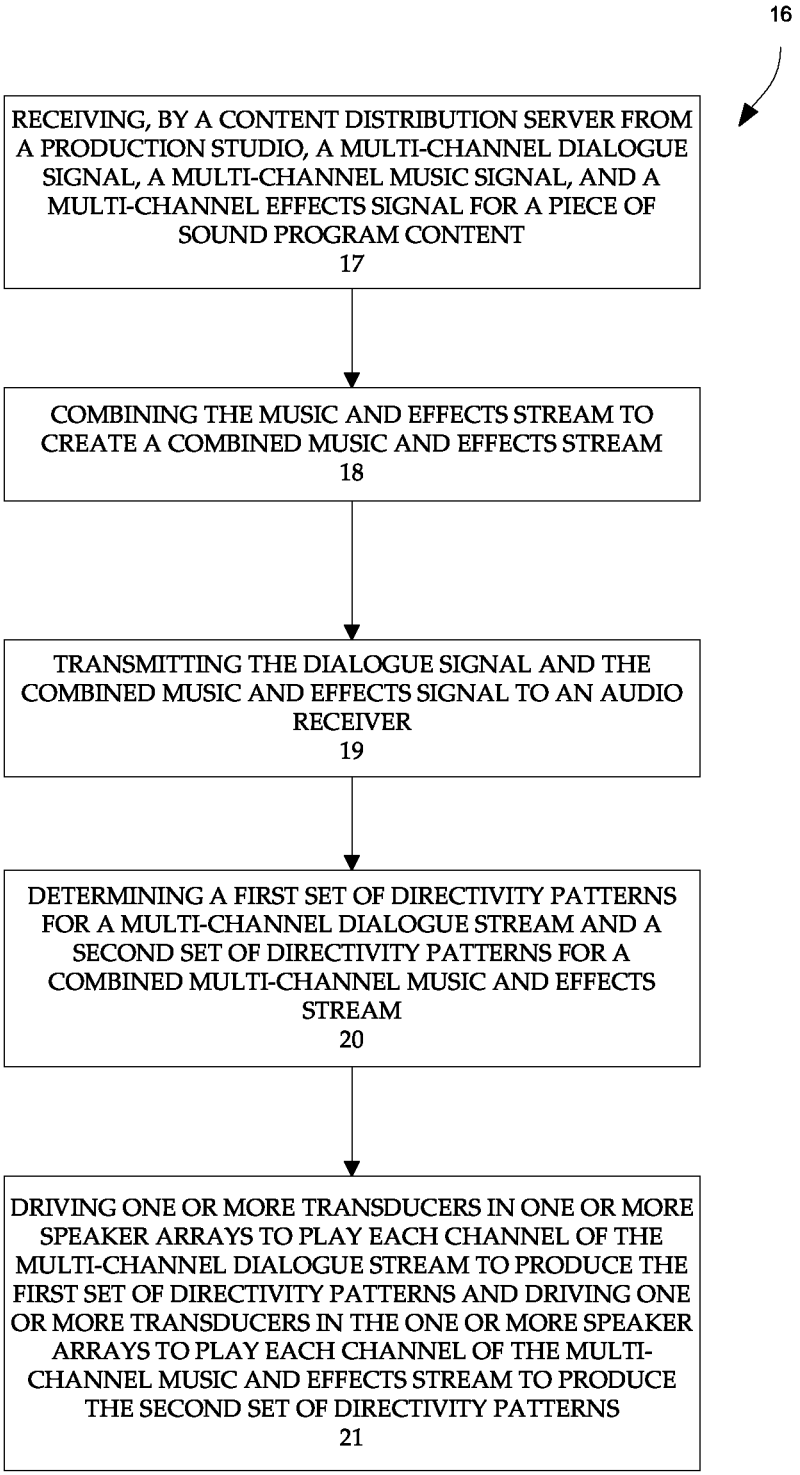
FIG. 5 shows a method for optimizing sound reproduction through adjustment of directivity of beam patterns applied to a dialogue signal/stem and a combined music and effects signal/stem according to one embodiment of the invention.

Turning now to FIG. 5, a method 16 for optimizing sound reproduction through adjustment of directivity of beam patterns applied to a dialogue signal/stem and a combined music and effects signal/stem will be described. The method 16 may be performed by one or more components of the receiver 2 or another computing device. For example, several operations of the method 16 may be performed by the array processor 12 and/or the directivity adjustment logic 13. However, in other embodiments, other components of the receiver 2 may also be used to perform the method 16.

Figure 6:
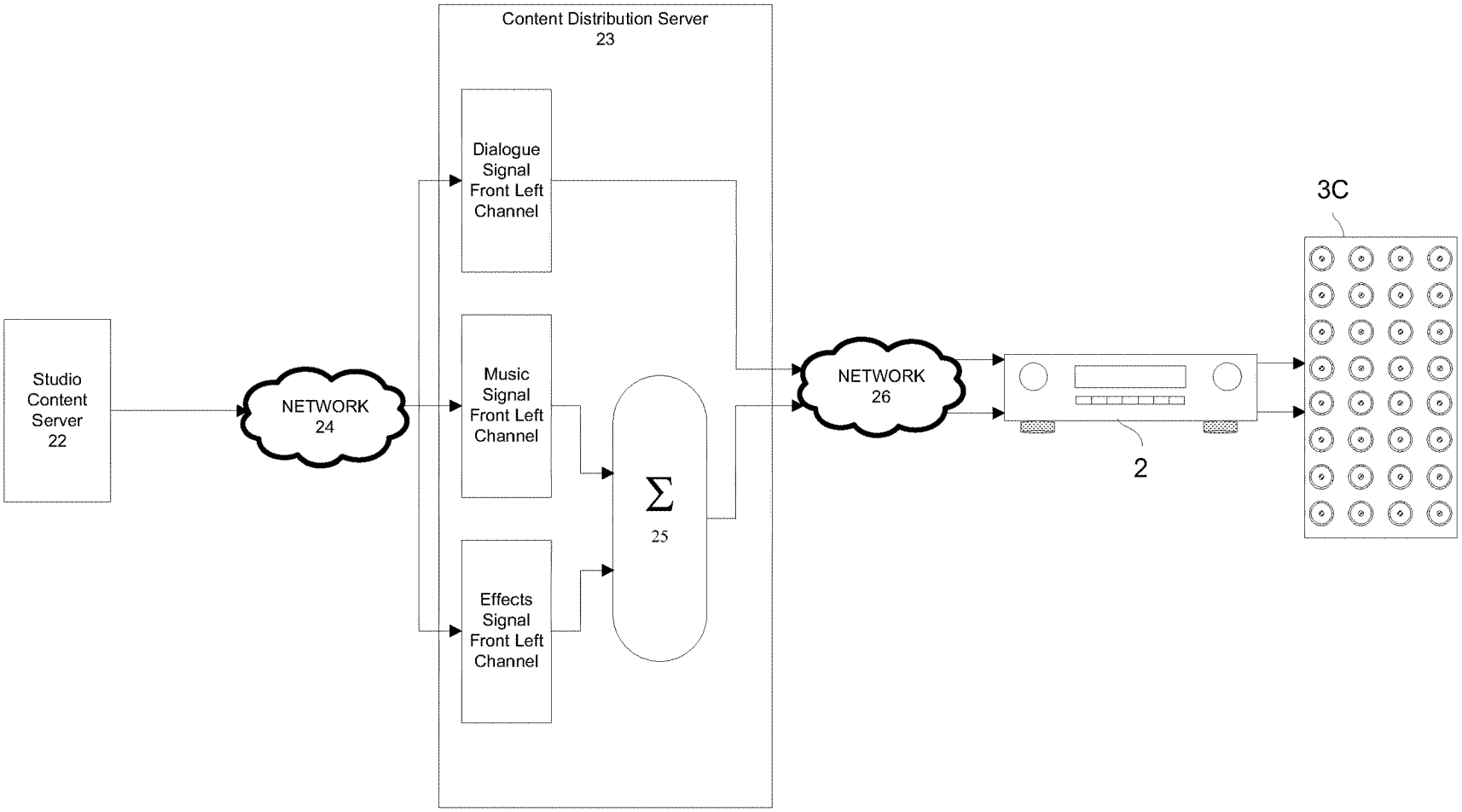
FIG. 6 shows the flow and processing of each component of a piece of sound program content according to one embodiment of the invention.

The method 16 may commence an operation 17 with the receipt of a piece of sound program content. The piece of sound program content may include multiple audio components or stems. For example, the sound program content may be an audio track for a movie and the audio components may include a multi-channel dialogue signal, a multi-channel music signal, and a multi-channel effects signal. As shown in FIG. 6 in relation to a single channel of the sound program content (e.g., the front left channel), in one embodiment, the sound program content may be transmitted from a studio content server 22 and received at operation 17 by a content distribution server 23. In this example, the studio content server 22 may transmit the sound program content over a network 24 or another medium to the content distribution server 23. The studio content server 22 may be operated by a production company that produces the sound program content and/or retains or manages distribution rights for the sound program content. In contrast, the content distribution server 23 may be operated by a retailer or distributor of the sound program content. Although shown in FIG. 6 as the transmission of a single channel of the sound program content (e.g., the left front channel of a multi-channel dialogue signal for a piece of sound program content), in other embodiments each channel of the sound program content may be transmitted by the studio content server 22 to the content distribution server 23.

At operation 18, the multi-channel music signal and the multi-channel effects signal received at operation 17 are mixed together to generate a combined multi-channel music and effects signal. This combination may be performed for each set of channels that comprise the multi-channel music signal and the multi-channel effects signal. For example, as shown in FIG. 6, the front left channel of the multi-channel music signal is combined with the front left channel of the multi-channel effects signal using the summation unit 25. The summation unit 25 may be a summing amplifier (e.g., opamps) or other solid state output circuitry. In other embodiments, the summation unit 25 may represent a software algorithm that is used to mix the multi-channel music signal with the multi-channel effects signal. In one embodiment, mixing the multi-channel music signal with the multi-channel effects signal produces a combined multi-channel music and effects signal with the same amount of channels as the original signals. For example, when a 5.1 music signal is combined with a 5.1 effects signal, the combined music and effects signal may also be a 5.1 audio signal. In other embodiments, the combined music and effects signal may be up or down mixed to produce a combined music and effects signal with more or less channels than the original signals.

As shown in FIG. 6, operation 18 may be performed in the content distribution server 23. However, in other embodiments, this combination at operation 18 may be performed by the studio content server 22 prior to transmission of the sound program content at operation 17 to the content distribution server 23.

Following combination of the multi-channel music signal with the multi-channel effects signal to produce a combined multi-channel music and effects signal, operation 19 transmits the multi-channel dialogue signal and the combined multi-channel music and effects signal to the receiver 2. As shown in FIG. 6, in one embodiment, the transmission at operation 19 may be performed over the network 26. The network 26 couples the content distribution server 23 to the receiver 2 using one or more wired and/or wireless mediums. For example, the network 26 may operate using Bluetooth, IEEE 802.3, the IEEE 802.11 suite of standards, cellular Global System for Mobile Communications (GSM), cellular Code Division Multiple Access (CDMA), or Long Term Evolution (LTE). In one embodiment, the network 24 is the same as the network 26, while in other embodiments the networks 24 and 26 are distinct and separate.

In one embodiment, the receiver 2 may receive the multi-channel dialogue signal and the combined multi-channel music and effects signal using one or more of the inputs 7A-7D. For example, in an embodiment in which the input 7A is a digital network interface, the receiver 2 may receive the multi-channel dialogue signal and the combined multi-channel music and effects signal using one or more network protocols.

Upon receiving the multi-channel dialogue signal and the combined multi-channel music and effects signal, operation 20 may determine a set of directivity patterns for the multi-channel dialogue signal and a separate set of directivity patterns for the combined multi-channel music and effects signal. In one embodiment, each directivity pattern determined at operation 20 may correspond to a separate channel of the multi-channel dialogue signal and the combined multi-channel music and effects signal. For example, for a 5.1 dialogue signal and a 5.1 combined music and effects signal, operation 20 may produce twelve directivity patterns (i.e., six directivity patterns for the six channels of the 5.1 dialogue signal and six directivity patterns for the six channels of the 5.1 combined music and effects signal).

In some embodiments, operation 20 may determine directivity patterns for a subset of channels in the multi-channel dialogue signal and the combined music and effects signal. For example, operation 20 may ignore a subwoofer channel such that separate directivity patterns are only generated for each mid and high range channel in the multi-channel dialogue signal and in the combined multi-channel music and effects signal. In this embodiment, the loudspeaker array 3F may be driven using a subwoofer channel of the dialogue and music and effects signals and/or low-frequency content of each other channel without directivity adjustment.

Each of the directivity patterns generated at operation 20 may be characterized by a directivity index. As noted above, directivity indexes describe the ratio of sound emitted at a target (e.g., the listener 4) in comparison to sound emitted generally into the listening area 1. For example, the directivity index for a beam pattern associated with the front center channel of the multi-channel dialogue signal may be 8 dB while the directivity index for a beam pattern associated with the front center channel of the combined multi-channel music and effects signal may be 3 dB. In this fashion, each channel of the dialogue signal and the combined music and effects signal may be separately adjusted according to audio preferences. For example, each channel of the dialogue signal may have a beam pattern with a higher directivity index than a corresponding channel of the music and effects signal. By associating dialogue components with a higher directivity than music and effects components, the method 16 increases the intelligibility of dialogue in a piece of sound program content while allowing music and effects to retain conventional directivity having a typical ratio of direct-to-reverberant sound energy.

In one embodiment, operation 20 may be performed by the directivity adjustment logic 13. The directivity adjustment logic 13 may be any set of hardware and software components that may determine directivity patterns with specified directivity indexes. In one embodiment, the directivity adjustment logic 13 may generate directivity patterns according to preferences of the user and/or based on the content or genre of the sound program content.

Although shown and described as operation 20 being performed by the receiver 2, in some embodiments operation 20 may be performed by the content distribution server 23. In these embodiments, data describing the beam patterns determined at operation 20 may be transported to the receiver 2 along with the multi-channel dialogue signal and the combined multi-channel music and effects signal. This beam pattern data may be stored as metadata for each of the dialogue and combined music and effects signals.

Figure 7A:
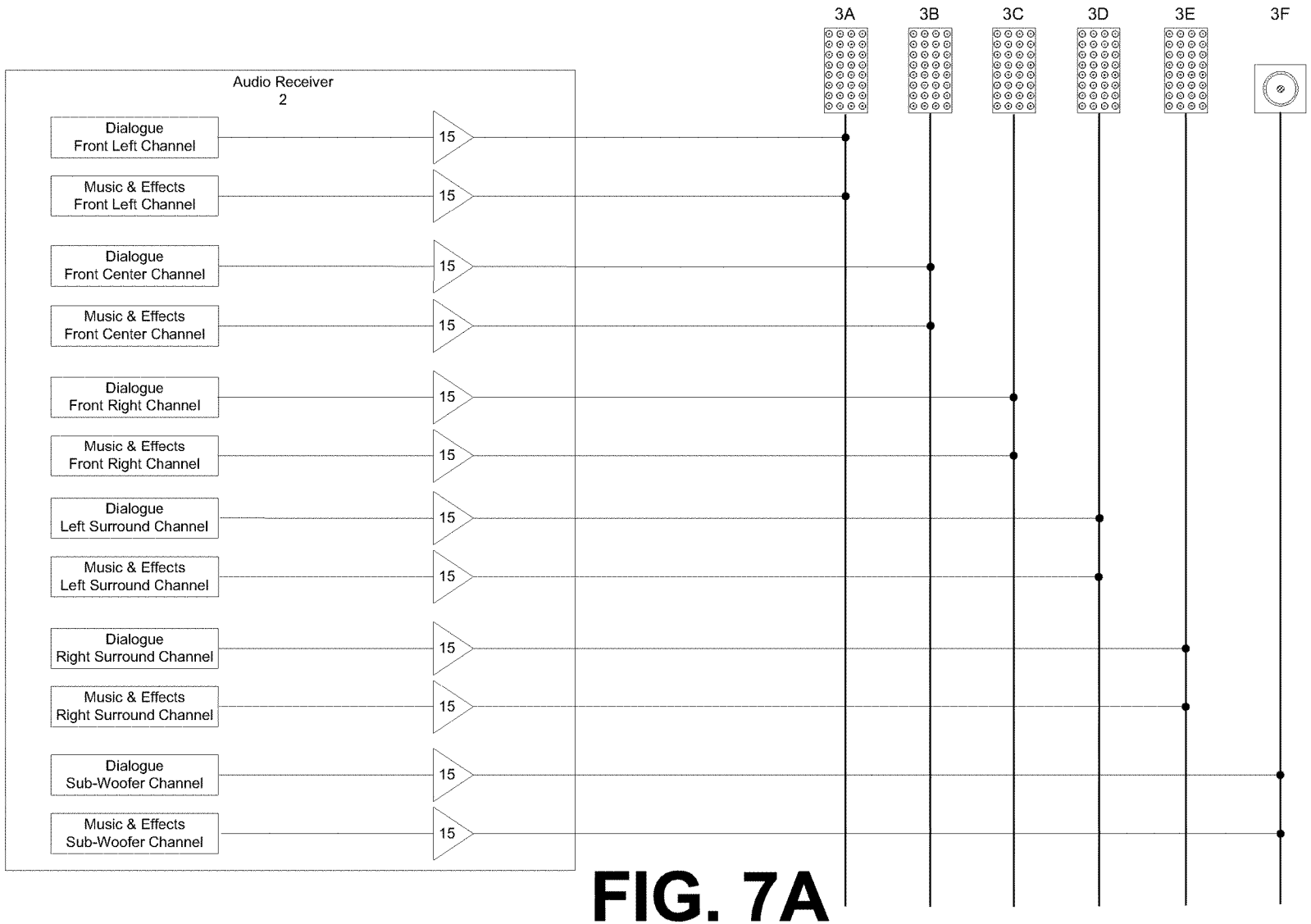
FIG. 7A shows the distribution of processed audio signals to six loudspeaker arrays according to one embodiment of the invention.

Following determination of a set of directivity patterns for each channel of both the multi-channel dialogue signal and the combined multi-channel music and effects signal, operation 21 may drive one or more loudspeakers 3A-3E to produce the directivity patterns from operation 20. In one embodiment, driving the loudspeaker arrays 3A-3E to produce the directivity patterns may include passing the generated directivity patterns to the array processor 12 of the receiver 2. The array processor 12 may generate a set of processed audio signals based on the directivity patterns and the audio signals/channels received from the multiplexer 10. In one embodiment, the array processor 12 may produce a set of processed audio signals for each channel of the multi-channel dialogue signal and each channel of the combined multi-channel music and effects signal. The processed audio signals may be transmitted at operation 21 to one or more transducers 5 in one or more of the loudspeakers 3A-3E using the digital-to-analog converters 14 and the power amplifiers 15 of the receiver 2. For example, as shown in FIG. 7A, processed audio signals corresponding to each channel of the multi-channel dialogue signal may be transmitted to a loudspeaker array 3A-3E. Similarly, processed audio signals corresponding to each channel of the combined multi-channel music and effects signal may be transmitted to a loudspeaker array 3A-3E.

Figure 7B:
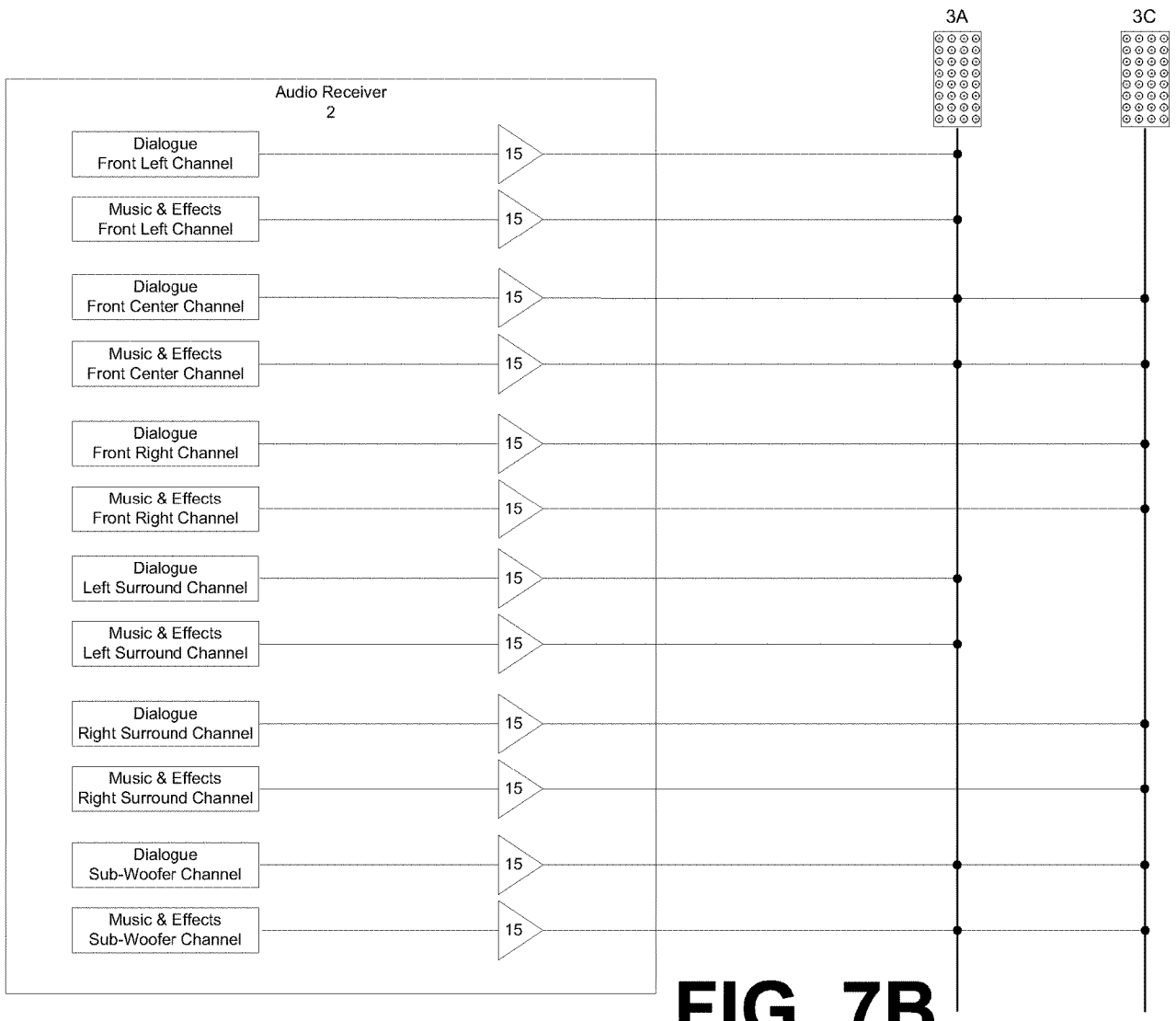
FIG. 7B shows the distribution of processed audio signals to two loudspeaker arrays according to one embodiment of the invention.

Although shown in FIG. 7A as a one-to-one correspondence of channels to the loudspeaker arrays 3A-3F, as shown in FIG. 7B processed audio signals may be split between multiple loudspeaker arrays 3A-3F such that loudspeaker arrays 3A-3F may collectively produce sound to represent a single corresponding channel. For example, as shown in FIG. 7B, processed audio signals for the front center channel of both the multi-channel dialogue signal and the combined multi-channel music and effects signal are transmitted to the loudspeaker arrays 3A and 3C. In this embodiment, the loudspeaker arrays 3A and 3C produce sound that represents the front center channel of both the multi-channel dialogue signal and the combined multi-channel music and effects signal. The generated front center channel may be considered a "phantom" channel that appears to emanate from a source directly in front of the listener 4, but is instead the product of sound produced by the loudspeaker arrays 3A and 3C, which are located to the left and right of the listener 4.

As noted above, directivity adjustment may be performed for a subset of channels in the multi-channel dialogue signal and the combined music and effects signal. For example, the method 16 may ignore a subwoofer channel such that separate directivity patterns are only generated for each mid and high range channel in the multi-channel dialogue signal and in the combined multi-channel music and effects signal. In this embodiment, the loudspeaker array 3F may be driven using a subwoofer channel of the dialogue and music and effects signals and/or low-frequency content of each other channel without directivity adjustment.

Figure 8:
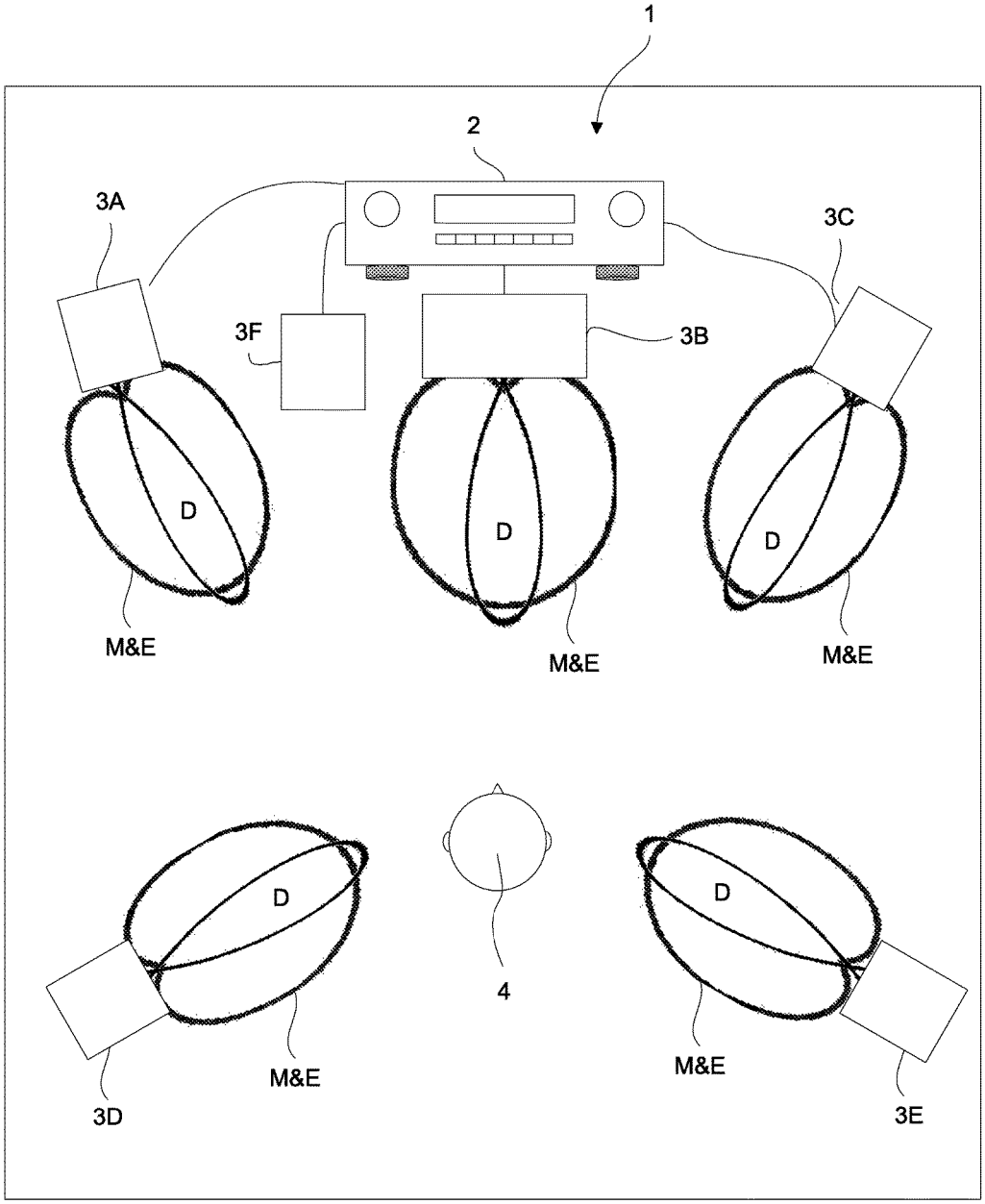
FIG. 8 shows the production of a first set of directivity patterns for a dialogue signal/stem for a piece of sound program content and a second set of directivity patterns for a combined music and effects signal set for the piece of sound program content according to one embodiment of the invention.

As shown in FIG. 8, the loudspeaker arrays 3A-3E may produce a first set of directivity patterns D corresponding to a multi-channel dialogue signal for a piece of sound program content and a second set of directivity patterns M&E corresponding to a combined multi-channel music and effects signal for the piece of sound program content. Each of the directivity patterns may be associated with separate directivity indexes that improve the reproduction of the piece of sound program content. For example, the directivity indexes for the dialogue signal may be set higher than the directivity indexes for the combined music and effects signal. In this fashion, the dialogue for the piece of sound program content may be intelligible while the music and effects retain conventional directivity having a typical ratio of direct-to-reverberant sound energy.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for playing a piece of sound program content, comprising:

receiving, from a server, a piece of sound program content and metadata, wherein the server a) combines a music signal with an effects signal to form a combined music and effects signal, resulting in a piece of sound program that includes a dialogue signal and a combined music and effects signal, b) determines a first directivity pattern for the dialogue signal of the piece of sound program content, the first directivity pattern characterized by a first directivity index, and c) determines a second directivity pattern for the combined music and effects signal of the piece of sound program content, the second directivity pattern characterized by a second directivity index, the second directivity index being less than the first directivity index, the first directivity pattern and second directivity pattern being included in the metadata; and driving transducers in a speaker array in accordance with a first set of processed audio signals to produce sound of the dialogue signal having the first directivity pattern, and in accordance with a second set of processed audio signals to produce sound of the music and effects signal having the second directivity pattern.

2. The method of claim 1, wherein the first directivity pattern is determined for each channel of a multi-channel dialog stem in the piece of sound program content, and the second directivity pattern is determined for each channel of a combined music and effects stem in the piece of sound program content.

3. The method of claim 1, wherein the server is a remote content distribution server over a network connection.

4. The method of claim 1, wherein the first directivity index is based on a ratio of dialogue sound emitted at a target to dialogue sound emitted generally into a listening area, and the second directivity index is based on a ratio of music and effects sound emitted at the target to music and effects sound emitted generally into the listening area.

5. A server for processing a piece of sound program content, comprising: a network interface of the server for receiving a multi-channel dialogue signal, a multi-channel music signal and a multi-channel effects signal for the piece of sound program content; and a hardware processor of the server to: combine a music signal with an effects signal to form a combined music and effects signal, determine a first directivity pattern for each channel of the multi-channel dialogue signal, the first directivity pattern characterized by a first directivity index, and determine a second directivity pattern for each channel of the combined multi-channel music and effects signal, the second directivity pattern characterized by a second directivity index, the second directivity index being less than the first directivity index, the first directivity pattern and second directivity pattern being included in metadata, wherein an audio receiver receives from the server a) the multi-channel dialogue signal, b) the combined multi-channel music and effects signal, and c) the metadata, and generates a first set of processed audio signals for transducers in a speaker array to produce sound of the dialogue signal having the first directivity pattern, and generates a second set of processed audio signals for the transducers in the speaker array to produce sound of the music and effects signal having the second directivity pattern.

6. An article of manufacture, comprising: a non-transitory machine-readable storage medium that stores instructions which, when executed by a processor in a server, determine a first directivity pattern for each channel of a multi-channel dialogue signal for a piece of sound program content, the first directivity pattern characterized by a first directivity index; determine a second directivity pattern for each channel of a combined multi-channel music and effects signal for the piece of sound program content, the second directivity pattern characterized by a second directivity index, the second directivity index being less than the first directivity index, the first directivity pattern and second directivity pattern being included in metadata; transmitting, by the server to an audio receiver, a) the multi-channel dialogue signal, b) the combined multi-channel music and effects signal, and c) the metadata, wherein the audio receiver generates a first set of processed audio signals for the channels of the combined multi-channel dialogue signal for transducers in a speaker array to produce sound of the multi-channel dialogue signal having the first directivity pattern, and generates a second set of processed audio signals for the channels of the combined multi-channel music and effects signal for the transducers in the speaker array to produce sound of the combined multi-channel music and effects signal having the second directivity pattern.

7. The article of manufacture of claim 6, wherein the article of manufacture is a remote content distribution server, that transmits the multi-channel dialogue signal, the combined multi-channel music and effect signal, and the metadata, to the audio receiver, over a network connection.

8. The article of manufacture of claim 6, wherein the first directivity index is based on a ratio of dialogue sound emitted at a target to dialogue sound emitted generally into a listening area, and the second directivity index is based on a ratio of music and effects sound emitted at the target to music and effects sound emitted generally into the listening area.

* * * * *